US009182731B2

(12) United States Patent
Ikeda et al.

(10) Patent No.: US 9,182,731 B2
(45) Date of Patent: Nov. 10, 2015

(54) END-SIDE MEMBER, PHOTORECEPTOR DRUM UNIT AND PROCESS CARTRIDGE

(71) Applicant: MITSUBISHI CHEMICAL CORPORATION, Chiyoda-ku (JP)

(72) Inventors: Shuichi Ikeda, Odawara (JP); Shinichi Iijima, Jurong (SG)

(73) Assignee: MITSUBISHI CHEMICAL CORPORATION, Chiyoda-ku (JP)

( * ) Notice: Subject to any disclaimer, the term of this patent is extended or adjusted under 35 U.S.C. 154(b) by 0 days.

(21) Appl. No.: 14/257,291

(22) Filed: Apr. 21, 2014

(65) Prior Publication Data

US 2014/0341612 A1 Nov. 20, 2014

Related U.S. Application Data

(60) Provisional application No. 61/823,028, filed on May 14, 2013, provisional application No. 61/843,157, filed on Jul. 5, 2013.

(30) Foreign Application Priority Data

Nov. 15, 2013 (JP) ..... 2013-236936

(51) Int. Cl.

| | |
|---|---|
| ***G03G 21/16*** | (2006.01) |
| ***G03G 21/18*** | (2006.01) |
| ***G03G 15/00*** | (2006.01) |

(52) U.S. Cl.

CPC ..... *G03G 21/1647* (2013.01); *G03G 15/757* (2013.01); *G03G 21/186* (2013.01); *G03G 2221/1657* (2013.01)

(58) Field of Classification Search

CPC ..... G03G 15/757; G03G 21/186; G03G 2221/1657

USPC ..... 399/159, 117, 167

See application file for complete search history.

(56) References Cited

U.S. PATENT DOCUMENTS

| | | | | |
|---|---|---|---|---|
| 5,903,803 | A | 5/1999 | Kawai et al. | |
| 5,926,673 | A * | 7/1999 | Foster et al. | 399/167 |
| 5,987,287 | A * | 11/1999 | Huang | 399/265 |
| 6,006,058 | A | 12/1999 | Watanabe et al. | |

(Continued)

FOREIGN PATENT DOCUMENTS

| | | |
|---|---|---|
| JP | 8-328449 | 12/1996 |
| JP | 10-153941 | 6/1998 |

OTHER PUBLICATIONS

Magnified view of Figure 7 of reference Jin (Pub No. US 2010/0196047 A1), Pub. date Aug. 5, 2010.*

*Primary Examiner* — Rodney Bonnette

(74) *Attorney, Agent, or Firm* — Oblon, McClelland, Maier & Neustadt, L.L.P.

(57) ABSTRACT

There is provided an end-side member to be arranged at an end of a photoreceptor drum unit which is detachably attached to an image forming apparatus body, the image forming apparatus body including a drive shaft having a concave portion, the concave portion being a hole having a substantially triangular cross-sectional shape and twisted in an extending direction of an axial line of the drive shaft. The end-side member includes a convex-shaped bearing member which is engageable with and disengageable from the concave portion. A depression to be engaged with a rim of an opening of the concave portion is formed in at least a part of an outer circumferential surface of the bearing member.

7 Claims, 20 Drawing Sheets

(56) References Cited

U.S. PATENT DOCUMENTS

| | | | |
|---|---|---|---|
| 6,128,454 | A | 10/2000 | Kawai et al. |
| 6,324,363 | B1 | 11/2001 | Watanabe et al. |
| 6,349,188 | B1 | 2/2002 | Kawai et al. |
| 2004/0086300 | A1 | 5/2004 | Kawai et al. |
| 2005/0163526 | A1 | 7/2005 | Kawai et al. |
| 2007/0104510 | A1 | 5/2007 | Kawai et al. |
| 2007/0104511 | A1 | 5/2007 | Kawai et al. |
| 2009/0031853 | A1* | 2/2009 | Mizuno et al. ..... 74/839 |
| 2010/0196047 | A1* | 8/2010 | Jin ..... 399/111 |

* cited by examiner

END-SIDE MEMBER, PHOTORECEPTOR DRUM UNIT AND PROCESS CARTRIDGE

CROSS REFERENCE TO RELATED APPLICATIONS

This application is based upon and claims the benefit of priorities of U.S. provisional application No. 61/823,028 filed on May 14, 2013, U.S. provisional application No. 61/843,157 filed on Jul. 5, 2013, and Japanese patent application No. 2013-236936 filed on Nov. 15, 2013, the contents of which are incorporated herein by reference in its entirety.

BACKGROUND OF THE INVENTION

1. Field of the Invention

The present invention relates to an end-side member used in an image forming apparatus such as a laser printer or a copy machine, and a photoreceptor drum unit and a process cartridge provided with the end-side member.

2. Description of the Related Art

An image forming apparatus such as a laser printer or a copy machine includes a process cartridge detachably provided at a body of the image forming apparatus (hereinafter, also referred to as an "apparatus body").

The process cartridge is a member which forms content of print, such as characters or drawings, while being attached to the apparatus body and transforms the content to a recording medium such as a paper. Therefore, the process cartridge is provided with a photoreceptor drum on which content to be transferred is formed and a charging tool and a developing tool for forming the content to be transferred to the photoreceptor drum.

In relation to the process cartridge, the same process cartridge is attached to or detached from the apparatus body for maintenance, or an old process cartridge is detached from the apparatus body and a new process cartridge is attached to the apparatus body to replace the old process cartridge with the new process cartridge. It is desirable that a user of the image forming apparatus can do such attachment and detachment of the process cartridge by themselves, and in that regards, it is desirable that such attachment and detachment of the process cartridge is easy to do.

In addition, the rotation of the photoreceptor drum included in the process cartridge when the photoreceptor drum is operated is necessary. Thus, the photoreceptor drum is provided with a bearing member such that a drive shaft of the apparatus body is engaged therewith in a direct manner or via another member and the photoreceptor drum receives rotation force from the drive shaft and rotates.

In contrast, it is necessary to release (separate) the engagement between the drive shaft of the apparatus body and the bearing member provided at the photoreceptor drum and reengage the drive shaft and the bearing member every time in order for the process cartridge to be attached to and detached from the apparatus body as described above.

JP-A-8-328449 and JP-A-10-153941 disclose techniques of providing a drive shaft moving in an axial direction on the apparatus body side, forming a twisted hole with a polygonal cross-sectional shape at the drive shaft, and providing, as a bearing member, a projection with a polygonal columnar shape which is inserted into the twisted hole at the drive shaft for delivering drive force. The projection disclosed in JP-A-8-328449 has a twisted columnar shape corresponding to the twisted hole at the drive shaft. In contrast, the projection disclosed in JP-A-10-153941 has a non-twisted columnar shape.

An object of both the techniques disclosed in JP-A-8-328449 and JP-A-10-153941 is to enhance rotation accuracy of the photoreceptor drum and to reliably deliver the drive force from the apparatus body to the photoreceptor drum.

SUMMARY OF THE INVENTION

However, according to the techniques in the related art disclosed in JP-A-8-328449 and JP-A-10-153941, there is a case where a problem occurs in rotation stability when enhancing a delivery of the rotation drive force.

Thus, one non-limited object of the present invention is to provide an end-side member capable of enhancing rotation stability of the photoreceptor drum. In addition, aspects of the present invention provide a photoreceptor drum unit and a process cartridge provided with the end-side member.

Hereinafter, description will be given of aspects of the present invention.

A first aspect of the present invention provides an end-side member to be arranged at an end of a photoreceptor drum unit which is detachably attached to an image forming apparatus body, the image forming apparatus body including a drive shaft having a concave portion, wherein the concave portion is a hole having a substantially triangular cross-sectional shape and twisted in an extending direction of an axial line of the drive shaft, the end-side member including: a convex-shaped bearing member which is engageable with and disengageable from the concave portion, wherein a depression to be engaged with a rim of an opening of the concave portion is formed in at least a part of an outer circumferential surface of the bearing member.

A second aspect of the present invention may provide the end-side member according to the first aspect, wherein a cross section of the bearing member in a direction orthogonal to an axial line of the bearing member has a polygonal shape.

A third aspect of the present invention may provide the end-side member according to the first aspect, wherein the polygonal shape is a hexagonal shape.

A fourth aspect of the present invention may provide the end-side member according to the first aspect, wherein the depression includes a first inclined surface, a bottom surface, and a second inclined surface in this order in a direction along the axial line of the bearing member from a root side toward a tip end side of the bearing member, and wherein at least one of the following equations (1) to (5) is satisfied: (1) $0.1 \leq L_1/L \leq 0.85$; (2) $0 \leq L_3/L \leq 0.65$; (3) $0.01 \leq d/L \leq 0.4$; (4) $1° \leq \theta_1 \leq 90°$; and (5) $1° \leq \theta_2 \leq 90°$, where L (mm) represents a length in an axial direction of the bearing member, $L_1$ (mm) represents a distance from a root of the bearing member to an end of the depression at the root-side of the bearing member, $L_3$ (mm) represents a distance of the bottom surface along the axial direction of the bearing member, d (mm) represents a depth of the depression, $\theta_1$ (°) represents an inclination angle of the first inclined surface with respect to the direction along the axial direction of the bearing member, and $\theta_2$ (°) represents an inclination angle of the second inclined surface with respect to the direction along the axial line of the bearing member.

A fifth aspect of the present invention may provide the end-side member according to the first aspect, wherein a depth of the depression becomes shallower in a direction along an outer circumferential direction of the bearing member.

A sixth aspect of the present invention may provide the end-side member according to the first aspect, wherein a cross section including the deepest part of the depression among cross sections in a direction orthogonal to the axial line of the bearing member has a shape by which at least all three sides of the cross section including the deepest part of the depression are overlapped with a part of a rim formed at an opening of the concave portion so as to coincide with the part of the rim.

A seventh aspect of the present invention may provide a photoreceptor drum unit including: a photoreceptor drum; and the end-side member as defined in any one of the first to sixth aspects, which is arranged on at least one end of the photoreceptor drum.

An eighth aspect of the present invention may provide a process cartridge including: the photoreceptor drum unit as defined in the seventh aspect; a charging roller which charges the photoreceptor drum in the photoreceptor drum unit; a developing roller which develops an electrostatic latent image on the photoreceptor drum; and a case body which accommodates the photoreceptor drum, the charging roller, and the developing roller.

According to the non-limited aspects of the present invention, it is possible to enhance engagement stability between the photoreceptor drum and the apparatus body and more stably rotate the photoreceptor drum.

DETAILED DESCRIPTION OF THE EXEMPLARY EMBODIMENTS

The aforementioned operations and advantages of the present invention will be clear by the description in the following embodiments. Hereinafter, description will be given of the embodiments with reference to drawings. However, the present invention is not limited to the embodiments.

Figure 1:
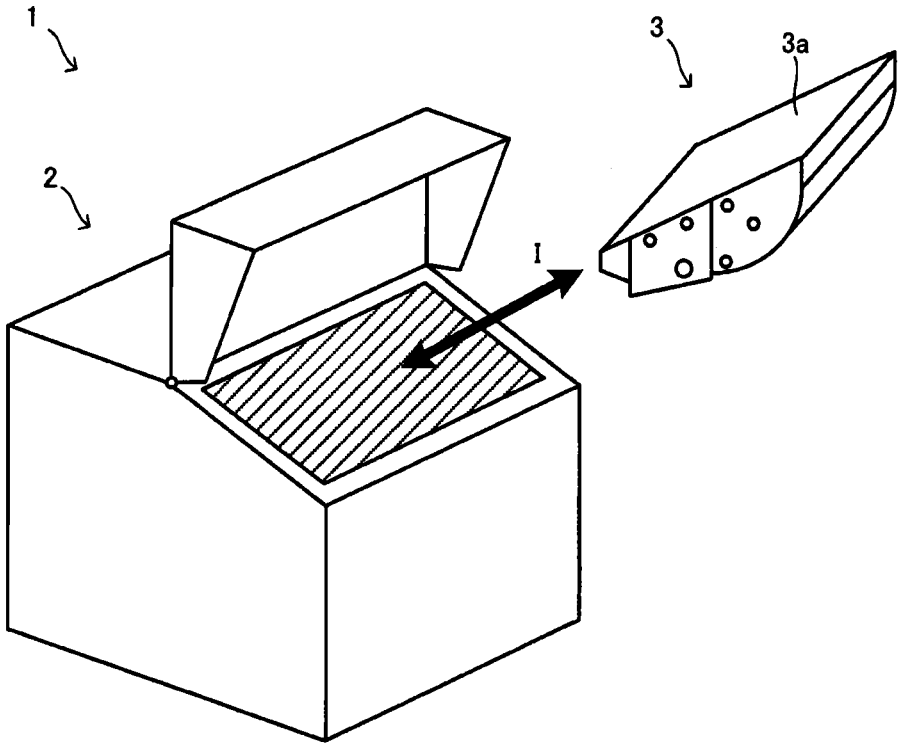
FIG. 1 is a diagram schematically illustrating an image forming apparatus according to a first embodiment.

FIG. 1 is a diagram illustrating a first embodiment, which is a perspective view schematically showing an image forming apparatus 1 including a process cartridge 3 and an image forming apparatus body 2 (hereinafter, also referred to as an "apparatus body 2") used with the process cartridge 3 attached thereto. The process cartridge 3 us attachable to and detachable from the apparatus body 2 by being moved in directions shown by a double-headed arrow I in FIG. 1.

Figure 2:
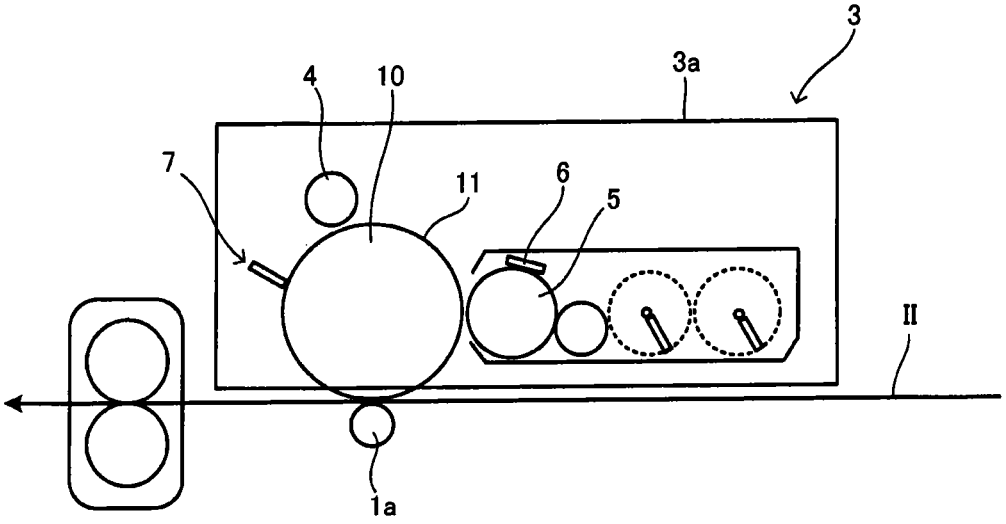
FIG. 2 is a diagram showing a concept of a structure of a process cartridge.

FIG. 2 schematically shows a configuration of the process cartridge 3. As can be understood from FIG. 2, the process cartridge 3 includes a photoreceptor drum unit 10 (see FIG. 3), a charging roller 4, a developing roller 5, a restriction member 6, and a cleaning blade 7 accommodated in a case body 3*a*. By moving a recording medium such as a paper along the arrow II shown in FIG. 2 while the process cartridge 3 is maintained in a posture of being attached to the apparatus body 2, an image is transferred to the recording medium.

In addition, the process cartridge 3 is attached to and detached from the apparatus body 2 substantially as follows. The photoreceptor drum unit 10 provided in the process cartridge 3 is rotated in response to the rotation drive force received from the apparatus body 2, and therefore, a drive shaft 70 (see FIG. 9) of the apparatus body 2 and a bearing member 40 (see FIG. 4) of the photoreceptor drum unit 10 engage one another at least when the photoreceptor drum unit 10 is operated. In contrast, the engagement between the drive shaft 70 of the apparatus body 2 and the bearing member 40 of the photoreceptor drum unit 10 is released when the process cartridge 3 is attached to or detached from the apparatus body 2.

Thus, the drive shaft 70 of the apparatus body 2 is configured to be movable in a direction along its axis line, for example, and the drive shaft 70 is in a posture of being detached from the bearing member 40 of the photoreceptor drum unit 10 when the process cartridge 3 is attached or detached. In contrast, the drive shaft 70 moves and is engaged with the bearing member 40 of the photoreceptor drum unit 10 after the process cartridge 3 is attached to the apparatus body 2.

As described above, it is necessary that the bearing member 40 of the photoreceptor drum unit 10 be appropriately engaged with the drive shaft 70 of the apparatus body 2 such that the rotation drive force is delivered.

Hereinafter, the respective configurations will be described.

As described above, the process cartridge 3 is provided with the charging roller 4, the developing roller 5, the restriction member 6, the cleaning blade 7, and the photoreceptor drum unit 10, and these components are accommodated in the case body 3*a*. The components are configured as follows.

The charging roller 4 charges a photoreceptor drum 11 of the photoreceptor drum unit 10 by applying voltage from the apparatus body 2. This is performed by the charging roller 4 rotated in accordance with the photoreceptor drum 11 and brought into contact with an outer circumferential surface of the photoreceptor drum 11.

The developing roller 5 is a roller which supplies a developer to the photoreceptor drum 11. In addition, an electrostatic latent image formed on the photoreceptor drum 11 is developed by the developing roller 5. Moreover, the developing roller 5 includes a built-in fixation magnet.

The restriction member 6 is a member which adjusts the amount of the aforementioned developer to adhere on the outer circumferential surface of the developing roller 5 and applies frictional electrification charge to the developer itself.

The cleaning blade 7 is a blade which is brought into contact with the outer circumferential surface of the photoreceptor drum 11 and removes, by the tip end thereof, the developer remaining after the transfer.

Figure 3:
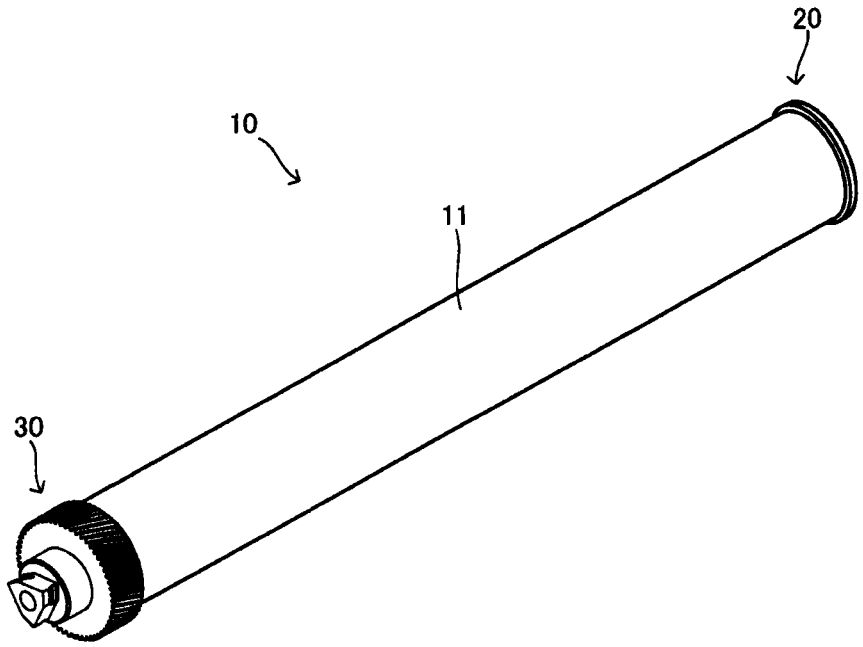
FIG. 3 is a perspective view of an appearance of a photoreceptor drum unit 10.

The photoreceptor drum unit 10 is provided with a photoreceptor drum 11. Characters, drawings, or the like to be transferred to the recording medium is formed thereon. FIG. 3 is a perspective view of an appearance of the photoreceptor drum unit 10. As can be understood from FIG. 3, the photoreceptor drum unit 10 is provided with the photoreceptor drum 11, a cover member 20, and an end-side member 30.

The photoreceptor drum 11 is a member which is obtained by coating the outer circumferential surface of a cylindrical base body with a photoreceptor layer. The characters, drawings, and the like to be transferred to the recording medium such as a paper are formed on the photoreceptor layer.

The base body is obtained from a conductive material made of aluminum or aluminum alloy being formed into a cylindrical shape. Although a kind of aluminum alloy used for the base body is not particularly limited, it is preferable to use 6000 series, 5000 series, or 3000 series aluminum alloy defined by the JIS standard (JIS H 4140) which is used as a base body of a photoreceptor drum in many cases.

In addition, the photoreceptor layer formed on the outer circumferential surface of the base body is not particularly limited, and a known photoreceptor layer can be applied in accordance with a purpose.

The base body can be manufactured by forming the cylindrical shape by a cutting process, an extrusion process, a drawing process, or the like. The photoreceptor drum 11 can be produced by laminating the photoreceptor layer on the outer circumferential surface of the base body by coating or the like.

To one end of the photoreceptor drum 11, at least two end-side members are attached in order for the photoreceptor drum 11 to rotate about the axial line as will be described later. One end-side member is the cover member 20, and the other end-side member is the end-side member 30.

The cover member 20 is an end-side member which is arranged at the end with which the drive shaft 70 of the apparatus body 2 does not engage, among the ends in the axial direction of the photoreceptor drum 11. The cover member 20 is arranged so as to cover one end side of the photoreceptor drum 11, and includes a fitting portion and a bearing portion which are coupled to the shaft.

The fitting portion is inserted into the photoreceptor drum 11 to fix the cover member 20 to the photoreceptor drum 11.

The bearing portion is arranged so as to cover one end side of the photoreceptor drum 11, and includes, at the center thereof, a bearing for receiving an axis on the side of the apparatus body 2.

Figure 4:
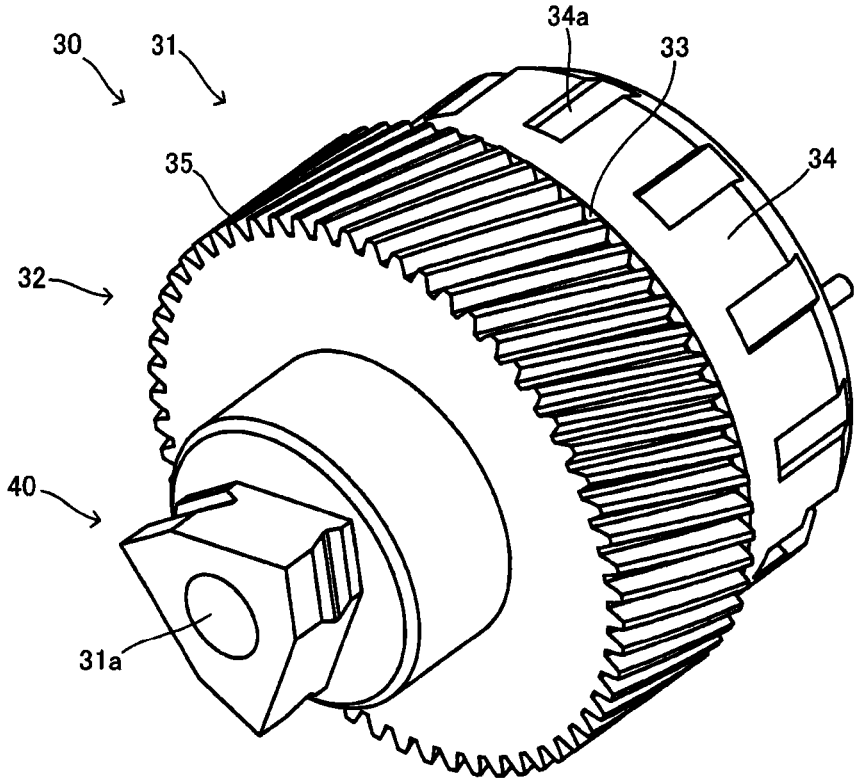
FIG. 4 is a perspective view of an end-side member 30.

The end-side member 30 is an end-side member arranged on the opposite side to the cover member 20 at an end with which the drive shaft 70 of the apparatus body 2 is engaged, among the ends of the photoreceptor drum 11 in the axial direction. FIG. 4 is a perspective view of an appearance of the end-side member 30. In addition, FIG. 5A is a front view of the end-side member 30 when viewed from the side of the bearing member 40, and FIG. 5B is a cross-sectional view taken along the line Vb-Vb in FIG. 5A.

The end-side member 30 is provided with a body 31 and conductive unit 61.

Figure 5A:
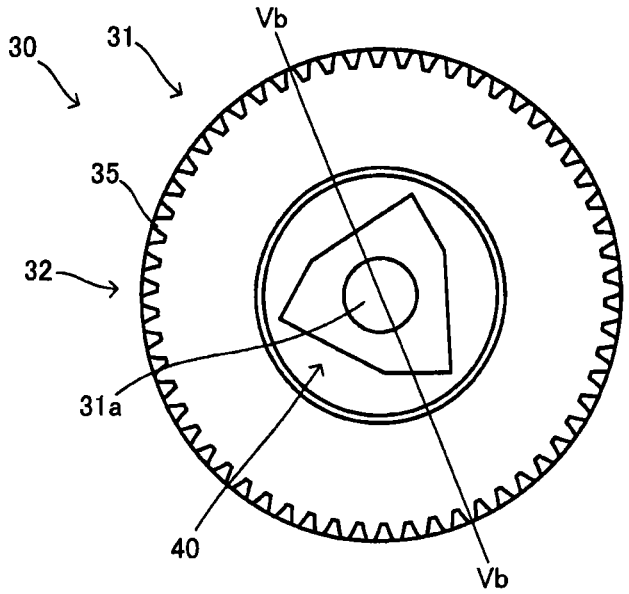
FIG. 5A is a front view of the end-side member 30 when a bearing member 40 is located on a closer side.
Figure 5B:
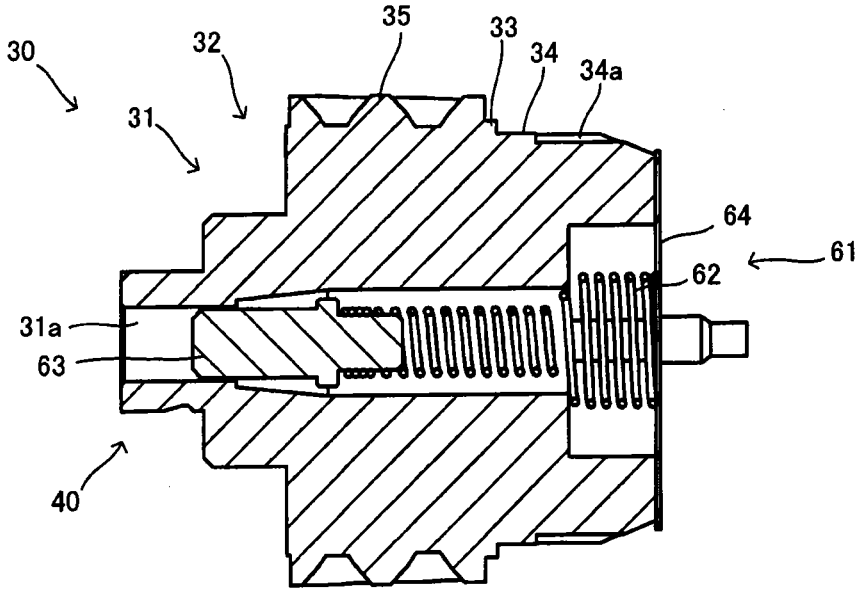
FIG. 5B is a cross-sectional view taken along a line Vb-Vb in FIG. 5A.

As can be understood from FIGS. 4, 5A, and 5B, the body 31 includes a cylindrical body 32, a contact wall 33, a fitting portion 34, a gear portion 35, and a bearing member 40.

Although concavities and convexities are formed on the outer circumferential surface and the inner circumferential surface of the cylindrical body 32 as necessary, the cylindrical body 32 is a cylindrical member as a whole, and the contact wall 33 which is latched in contact with an end surface of the photoreceptor drum 11 is provided so as to be erect from a part of the outer circumferential surface of the cylindrical body 32. With such a configuration, an insertion depth of the end-side member 30 into the photoreceptor drum 11 is restricted in a posture in which the end-side member 30 is attached to the photoreceptor drum 11.

One side of the cylindrical body 32 from the contact wall 33 corresponds to the fitting portion 34 to be inserted into the photoreceptor drum 11. The fitting portion 34 is inserted into the photoreceptor drum 11 and is fixed to the inner surface of the photoreceptor drum 11 by an adhesive agent. With such a configuration, the end-side member 30 is fixed to the end of the photoreceptor drum 11. Accordingly, the outer diameter of the fitting portion 34 is substantially the same as the inner diameter of the photoreceptor drum 11 within a range in which the fitting portion 34 can be inserted into the cylindrical shape of the photoreceptor drum 11.

The fitting portion 34 may include a groove 34*a* formed in the outer circumferential surface thereof. With such a configuration, the groove 34*a* is filled with an adhesive agent, and adhesiveness between the body 31 (end-side member 30) and the photoreceptor drum 11 is enhanced due to an anchor effect and the like.

The gear portion 35 is formed on the outer circumferential surface of the cylindrical body 52 on the opposite side to the fitting portion 34 from the contact wall 33. The gear portion 35 is a gear for delivering rotation force to other members such as the developing roller, and a helical gear is arranged in this embodiment. However, a kind of the gear is not particularly limited, a spur gear may be arranged, or both the helical gear and the spur gear may be arranged so as to be aligned in the axial direction. Alternately, a gear may not be provided if it is not necessary.

Furthermore, the bearing member 40 is provided coaxially with the cylindrical body 32 at the end on the opposite side to the side corresponding to the fitting portion 34 among the ends of the cylindrical body 32 in the axial direction. The bearing member 40 is a member engaged with a concave portion 71 provided at the drive shaft 70, which will be described later, of the apparatus body 2 and has a function of delivering rotation force from the drive shaft 70 to the end-side member 30. In addition, the bearing member 40 is configured to separate from the concave portion 71 of the drive shaft 70 when the process cartridge 3 is attached to and detached from the apparatus body 2. Hereinafter, description will be given of the shape of the bearing member 40 according to this embodiment.

Figure 6:
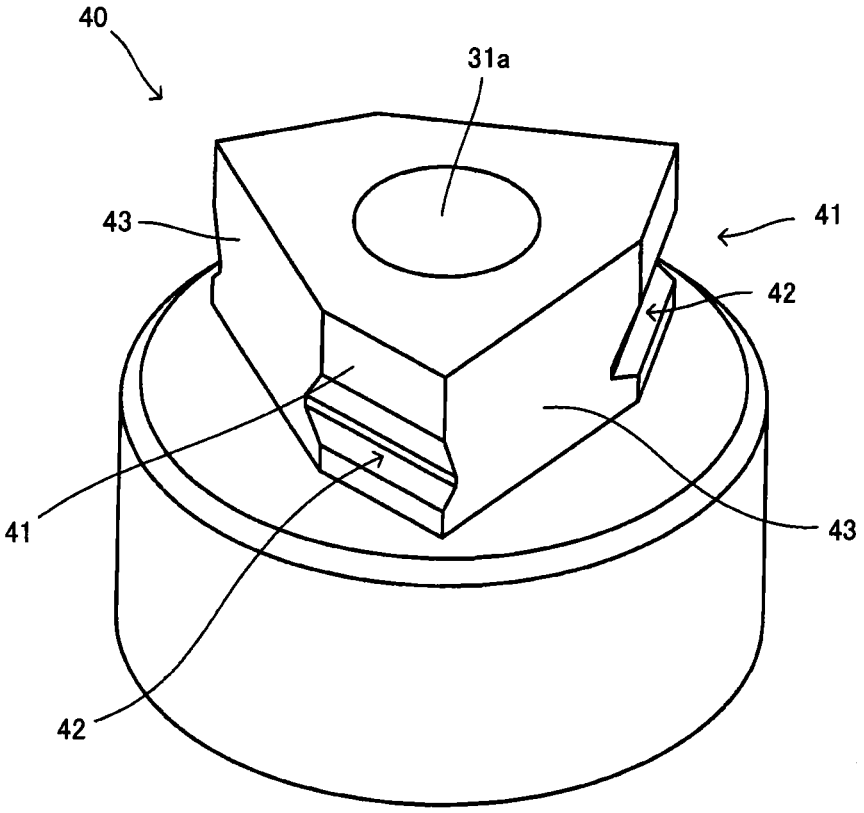
FIG. 6 is a perspective view mainly showing the bearing member 40.
Figure 7:
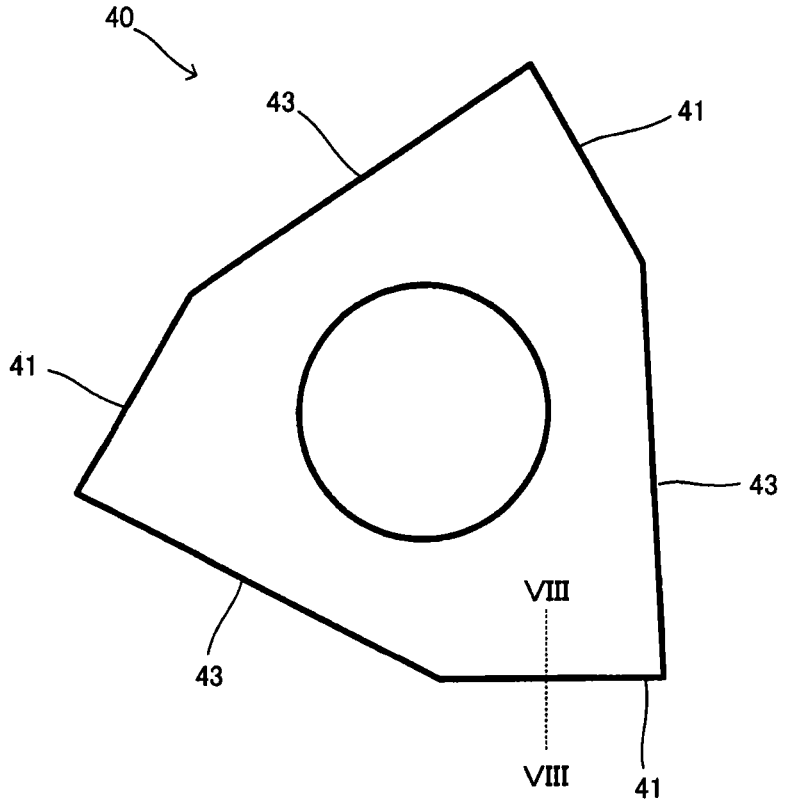
FIG. 7 is a front view of the bearing member 40.

FIG. 6 is a perspective view mainly showing the bearing member 40, and FIG. 7 is a front view of the bearing member 40 when viewed from the axial direction. The bearing member 40 according to this embodiment has a cross section with a hexagonal outer circumferential shape in a direction orthogonal to the axial direction. In addition, the bearing member 40 does not have a so-called twisted shape in a direction along the axial direction and is a hexagonal column which has a cross section with a constant size and a constant direction except for a part corresponding to a depression 42. With such a configuration, the bearing member 40 delivers rotation force by being appropriately engaged with the concave portion 71 which is formed such that a triangular cross-section of the drive shaft 70 is consecutively twisted as will be described later, and attachment and detachment are facilitated.

Although the embodiment is described as an example in which the outer circumference of the cross section of the bearing member 40 in a direction orthogonal to the axial direction is a hexagonal shape, the shape is not limited thereto, and another shape such as a polygonal shape other than the hexagonal shape may be employed.

Among the outer circumferential surfaces forming the hexagonal cross-sectional shape of the bearing member 40, three separate surfaces (41) correspond to rotation force delivering surfaces 41 which are brought in contact with the concave portion 71 of the drive shaft 70 and deliver the rotation force in this embodiment. According to this embodiment, the rotation force delivering surfaces 41 are arranged at every two outer circumferential surfaces forming the hexagonal cross-sectional shape of the bearing member 40, and a connecting surface 43 is arranged between adjacent rotation force delivering surfaces 41. Accordingly, the three rotation force delivering surfaces 41 and the three connecting surfaces 43 are alternately arranged and form the hexagonal shape of the outer circumferential surfaces of the bearing member 40.

The rotation force delivering surfaces 41 and the connecting surfaces 43 are formed so as to be in contact with the concave portion 71 such that the bearing member 40 can be inserted into the concave portion 71 of the drive shaft 70 and the rotation force delivering surface 41 can deliver the rotation force in the posture in which the bearing member 40 is inserted.

As shown in FIG. 6, groove-shaped depressions 42 which are formed by digging into the rotation force delivering surfaces 41 so as to extend in a circumferential direction of the outer circumference of the bearing member 40 are provided in the rotation force delivering surface 41. According to this embodiment, the depressions 42 are formed in the rotation force delivering surface 41 so as to cross over the adjacent connecting surfaces 43.

By providing the depressions 42 in the rotation force delivering surfaces 41 as described above, a rim portion (edge) of the concave portion 71 of the drive shaft 70 is engaged with the depressions 42, and it is possible to stably deliver the rotation force. The configuration thereof will be described in detail later.

Figure 8A:
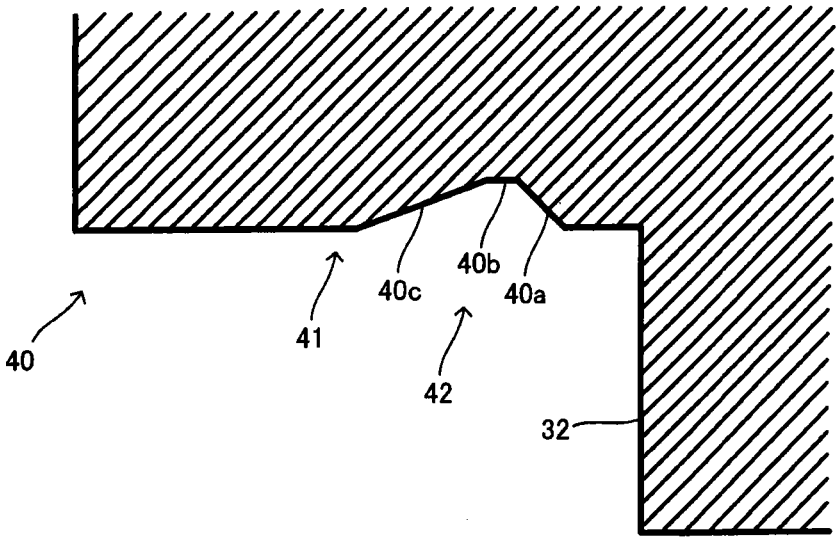
FIG. 8A is a diagram showing a cross-sectional shape of a depression 42.
Figure 8B:
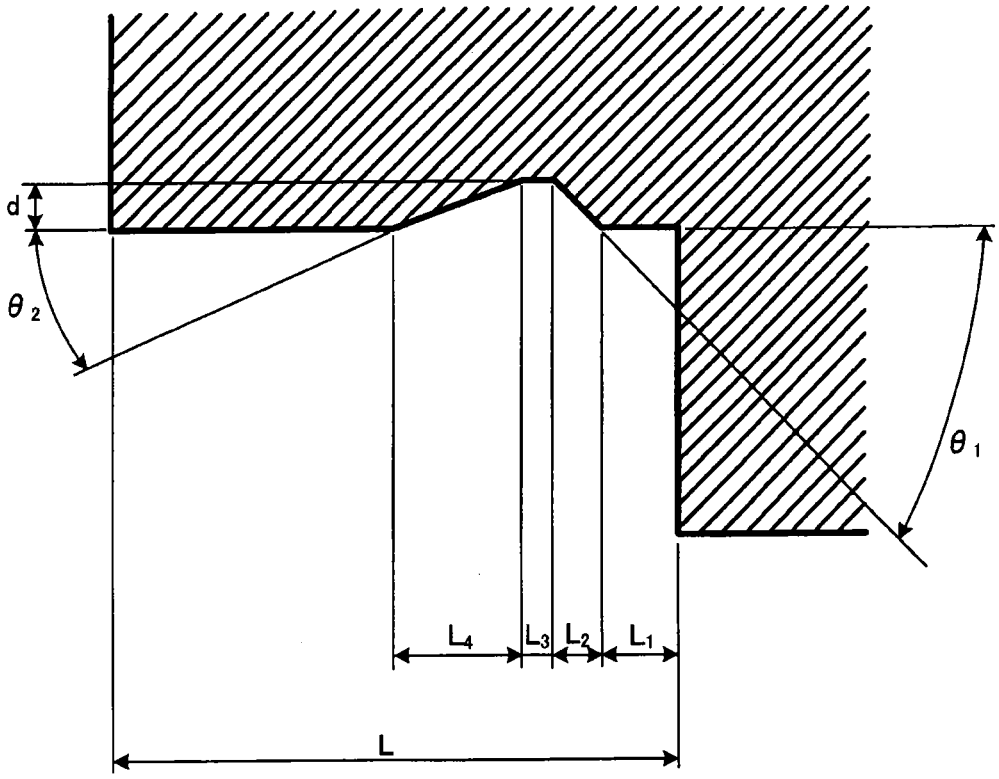
FIG. 8B is a diagram illustrating the dimension of the depression 42.

Here, the cross-sectional shape of each depression 42 in a depth direction (a cross-sectional shape in a direction in which the depression 42 is orthogonal to a circumferential extending direction of the bearing member 40, namely a cross-sectional shape in a direction orthogonal to a longitudinal direction of the depression 42 is preferably provided with the following configuration in order to further stably deliver rotation force. FIGS. 8A and 8B are diagrams for illustrating the configuration. FIG. 8A is an end surface diagram of the bearing member 40 taken along the line VIII-VIII in FIG. 7. Accordingly, FIG. 8A shows the cross-sectional shape of the depression 42 in the depth direction. In FIG. 8A, the left side of the paper corresponds to a tip end side of the bearing member 40, and the right side of the paper corresponds to the root side (the side of the cylindrical body 32) of the bearing member 40.

FIG. 8B is a diagram from the same observing point as that in FIG. 8A, which is a diagram defining a dimension of each part in the depression 42.

The depression 42 includes a bottom portion with a predetermined configuration from the root side (the side of the cylindrical body 32) toward the tip end side as can be understood from FIG. 8A. Specifically, the depression 42 includes a root-side inclined surface 40*a* as a first inclined surface, a bottom surface 40*b*, and a tip-end-side inclined surface 40*c* as a second inclined surface. Therefore, the depression 42 gradually becomes deeper from the end on the root side and the tip end side toward the root-side inclined surface 40*a* and the tip-end-side inclined surface 40*b*, and the deepest part is formed at the bottom surface 40*b*.

The dimensions of the parts of such a depression 42 and the relating rotation force delivering surface 41 will be defined as follows. Here, it is assumed that L (mm) represents the height (the length in the axial direction) of the bearing member 40.

(a) A distance from the root of the bearing member 40 to the end of the depression 42 at the root-side: $L_1$ (mm)

(b) A distance of the root-side inclined surface 40*a* in a direction parallel to a height direction of the bearing member 40: $L_2$ (mm)

(c) A distance of the bottom surface 40*b* in a direction parallel to the height direction of the bearing member 40: $L_3$ (mm)

(d) A distance of the tip-end-side inclined surface 40*c* in a direction parallel to the height direction of the bearing member 40: $L_4$ (mm)

(e) A depth of the depression 42: d (mm)

(f) An inclination angle of the root-side inclined surface 40*a* with respect to the height direction of the bearing member 40: $\theta_1$ (°)

(g) An inclination angle of the tip-end-side inclined surface 40*c* with respect to the height direction of the bearing member 40: $\theta_2$ (°)

It is preferable to satisfy at least one of relationships expressed in the following Equations (1) to (5) in relation to the respective dimensions defined above.

$$0.1 \le L_1/L \le 0.85 \quad (1)$$

There is a concern that the depression 42 is not appropriately engaged with the drive shaft 70 if $L_1/L$ is less than 0.1, and in contrast, there is a possibility that stability in rotation delivery deteriorates if $L_1/L$ is greater than 0.85 since the engagement with the drive shaft 70 occurs in the vicinity of the tip end of the bearing member 40.

$$0 \le L_3/L \le 0.65 \quad (2)$$

If $L_3/L$ is greater than 0.65, an allowable range in which the drive shaft can move in the axial direction increases, and therefore, there is a tendency that the stability in rotation delivery deteriorates. In addition, Equation (2) allows a case of $L_3=0$, no bottom surface 40*b* is provided at this time, and the root-side inclined surface 40*a* and the tip-end-side inclined surface 40*c* form a V-shaped depression 42.

$$0.01 \leq d/L \leq 0.4 \quad (3)$$

If d/L is less than 0.01, the depression 42 becomes shallow, and therefore, there is a concern that the stability in the engagement with the drive shaft 70 deteriorates. In contrast, if d/L is greater than 0.4, it is difficult to bring the drive shaft 70 into contact with the deepest part of the depression 42 in some cases, and therefore, a further increase in d/L have no meaning.

$$1° \leq \theta_1 \leq 90° \quad (4)$$

Since the depression 42 becomes shallow in an indirect manner if $\theta_1$ is less than 1°, there is a concern that the stability in the engagement with the drive shaft 70 deteriorates in the same manner in the case where d/L is less than 0.01. In contrast, it is difficult to perform molding when $\theta_1$ is greater than 90°.

$$1° \leq \theta_2 \leq 90° \quad (5)$$

Since the depression 42 becomes shallow in an indirect manner similar to the case of $\theta_1$ if $\theta_2$ is less than 1°, there is a concern that the stability in the engagement with the drive shaft 70 deteriorates similar to the case where d/L is less than 0.01. In contrast, it is difficult to perform molding similar to the case of $\theta_1$ when $\theta_2$ is greater than 90°.

$$L_1+L_2+L_3+L_4<L \quad (6)$$

Equation (6) is a condition for limiting ranges of the values in order to avoid inconsistency of Equations (1) to (5).

Here, $L_2$ and $L_4$ can be expressed by the following Equations (7) and (8), respectively.

$$L_2=d/\tan\theta_1 \quad (7)$$

$$L_4=d/\tan\theta_2 \quad (8)$$

Returning to FIGS. 4 and 5B, further description will be given of the body 31. Since the body 31 has a cylindrical shape as described above, a single hole 31*a* communicating therethrough is formed inside the body 31 and penetrates the body 31 in the axial direction. The diameter of the hole 31*a* is set to a size with which an end of a body-side earth member 72 (see FIG. 10) of the drive shaft 70 as will be described later can be inserted into the hole 31*a*.

In addition, the body 31 is preferably formed of resin such as crystalline resin or amorphous resin. If crystalline resin is employed, satisfactory molding workability is achieved, and it is possible to significantly enhance productivity. It is possible to exemplify, as crystalline resin, polyethylene, polypropylene, polyamide, polyacetal, polyethylene terephthalate, polybutylene terephthalate, methylpentene, polyphenylene sulfide, polyether ether ketone, polytetrafluoroethylene, and nylon, and among the examples, it is preferable to use polyacetal-based resin from a viewpoint of molding workability. In addition, the body 31 may be filled with glass fiber, carbon fiber, or the like from a viewpoint of enhancing strength.

In contrast, it is possible to expect dimensional stability and high strength if amorphous resin is used. As such amorphous resin, it is possible to exemplify polycarbonate.

Returning to FIG. 5B, description will be given of the conductive means 61. The conductive means 61 is means for electrically connecting the photoreceptor drum 11 and the apparatus body 2, and is provided with a coil spring 62, a conductive bar 63, and an earth plate 64.

The coil spring 62 functions as a conductive material which is elastically deformed. Specifically, the coil spring 62 according to this embodiment is a helical spring formed such that a single wire rod is spirally wound. The coil spring 62 is inserted into the hole 31*a* and is formed to be conductive by containing a conductive material. Therefore, the coil spring 62 is preferably formed of metal such as steel or copper. As can be understood from FIG. 5B, the coil spring 62 according to this embodiment has different winding diameters on one side and the other side in the axial direction.

The conductive bar 63 is a bar-shaped member with a conductive property, has a thickness with which the conductive bar 63 can be fitted into the hole 31*a*, and has a length with which one end thereof is in contact with the coil spring 62 and the other end reaches the vicinity of an opening of the hole 31*a* on a side of the bearing member 40 (a side opposite to the side on which the earth plate 64 is arranged). The conductive bar 63 can be formed of metal such as copper or steel.

Here, the conductive bar 63 may be provided with a member (retainer) for restricting movement of the conductive bar 63 in a direction, in which the conductive bar 63 falls off, at a predetermine position for the purpose of preventing the conductive bar 63 from unnecessary moving to the side of the apparatus body. As such a configuration, it is possible to exemplify a configuration in which a part of the hole 31*a* is formed to be narrower and a configuration in which a projection is provided at an outer circumferential portion of the conductive bar 63 so as to be caught by the hole 31*a*.

The earth plate 64 is a disc-shaped member with a conductive property and includes a projecting portion formed at the outer circumferential surface thereof so as to be in contact with the inner surface of the photoreceptor drum 11. The earth plate 64 is the same as a known earth plate, a structure thereof is not particularly limited, and a known shape can be applied.

The aforementioned body 31 and the conductive means 61 are combined to form the end-side member 30. That is, the earth plate 64 is arranged on the end surface of the fitting portion 34 of the body 31 such that the surfaces thereof are overlapped with each other and fixed by swaging as shown in FIG. 5B. The coil spring 62 is inserted into the hole 31*a* formed at the body 31. Here, an end of the coil spring 62, which is arranged on the side of the fitting portion 34, is in contact with the earth plate 64. The conductive bar 63 is arranged on a side opposite to a side on which the coil spring 62 is in contact with the earth plate 64, the coil spring 62 is also inserted into the hole 31*a*, and one end of the conductive bar 63 is inserted into and in contact with the end of the coil spring 62. Here, the conductive bar 63 is biased by the coil spring 62 and is in a state of being pressed to the side opposite to the earth plate 64.

Figure 11:
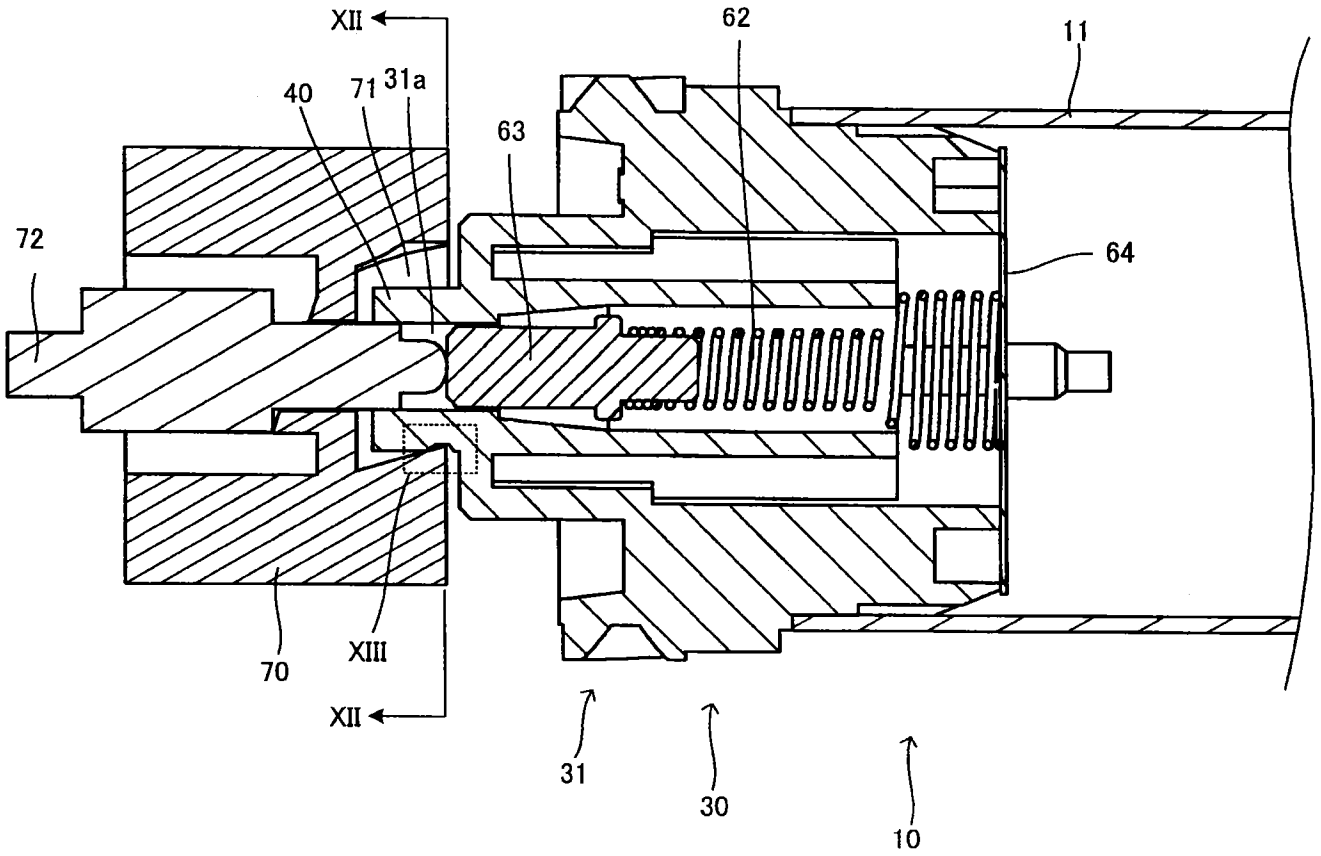
FIG. 11 is a cross-sectional view in a direction along an axial direction in the vicinity of the drive shaft 70 and the end-side member 30 in a case when a process cartridge 2 including the photoreceptor drum unit 10 is attached to an apparatus body 3.

The cover member 20 is attached to one end of the photoreceptor drum 11 as described above, the fitting portion 34 of the end-side member 30 is inserted into the other end of the photoreceptor drum 11 up to a position at which the fitting portion 34 of the end-side member 30 is brought into contact with the contact wall 33, and the photoreceptor drum unit 10 as shown in FIG. 3 is obtained (also see FIG. 11). Here, the projecting portion of the earth plate 64 is in contact with the inner surface of the photoreceptor drum 11.

Next, description will be given of the photoreceptor drum unit 10 in the posture in which the process cartridge 3 including the photoreceptor drum unit 10 is attached to the image forming apparatus.

Figure 9A:
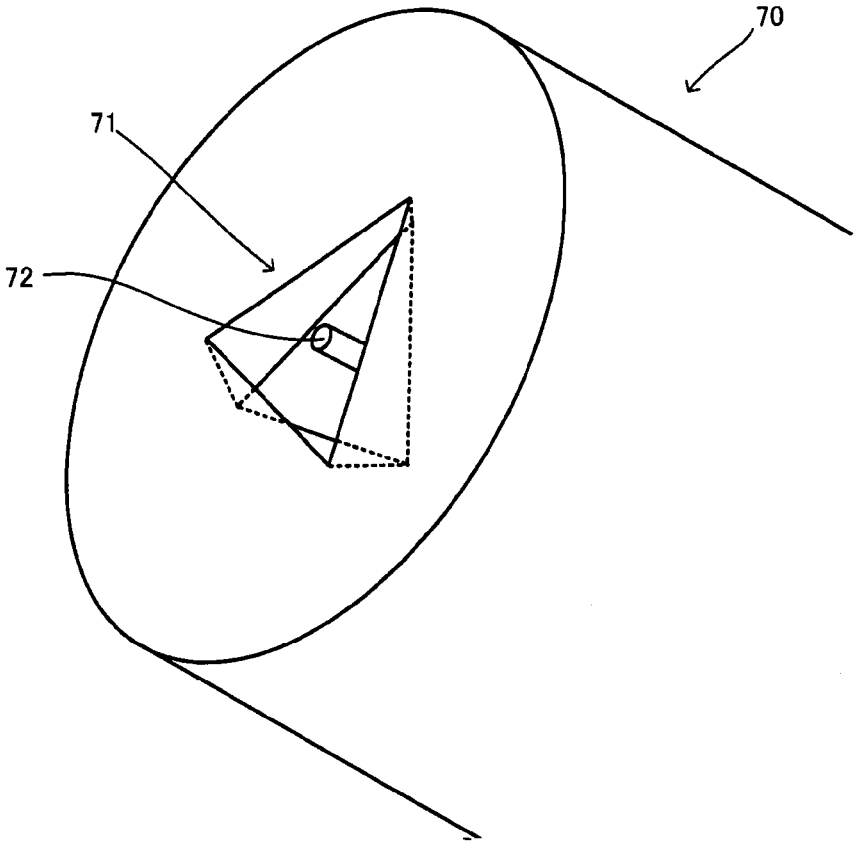
FIG. 9A is a perspective view of a drive shaft 70.
Figure 9B:
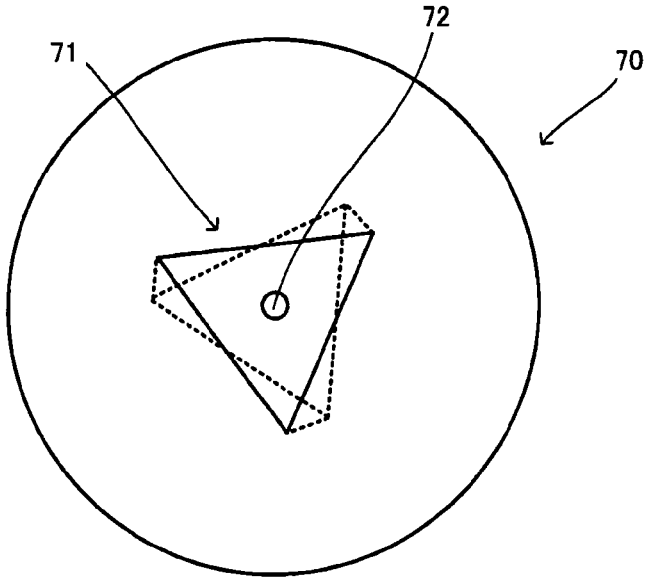
FIG. 9B is a front view of the drive shaft 70.

Here, the drive shaft 70 of the apparatus body 2 will be described first. The known configurations can be used for the other parts in the apparatus body 2. FIG. 9 shows an end of the drive shaft 70 for applying rotation drive force to the photoreceptor drum unit 10, which is provided in the apparatus body 2 on a side of being engaged with the bearing member 40. FIG. 9A is a perspective view, and FIG. 9B is a front view when viewed in the axial direction. In FIGS. 9A and 9B, a part of the concave portion 71 is shown in a transparent manner by broken lines. Another end of the drive shaft 70 on the opposite side is directly or indirectly coupled to a drive source of the apparatus body 2.

As can be understood from FIGS. 9A and 9B, the concave portion 71 is provided in the end surface of the drive shaft 70. The concave portion 71 is a hole which has a cross section with a substantially regular triangular shape and has a shape obtained by twisting an axial line thereof about a center by a predetermined angle from the end surface of the drive shaft 70 toward the depth direction of the axial direction. The twisting direction is a clockwise direction or a counterclockwise direction depending on a rotation delivery direction.

In addition, a body-side earth member 72 with a conductive property and a bar shape is arranged at the drive shaft 70 along the axial line of the drive shaft 70. As shown in FIGS. 9A and 9B, one end side of the body-side earth member 72 projects so as to be erect from the bottom of the concave portion 71. In contrast, the other end side of the body-side earth member 72 projects from an end of the drive shaft 70 on the opposite side and is in contact with a member for an earth of the apparatus body 2.

As can be understood from FIG. 9B, a triangle (shown by a solid line) formed at an opening of the concave portion 71 and a triangle (shown by a broken line) formed at the bottom of the concave portion 71 appear such that the two triangles rotated about an axis are overlapped with each other when the concave portion 71 is viewed from a front side in the axial direction in a see-through manner. Although the description is given herein of the example in which the cross-section of the concave portion 71 is a triangle, a polygonal shape obtained by slightly cutting a vertex of a reference triangle may be employed.

Figure 10:
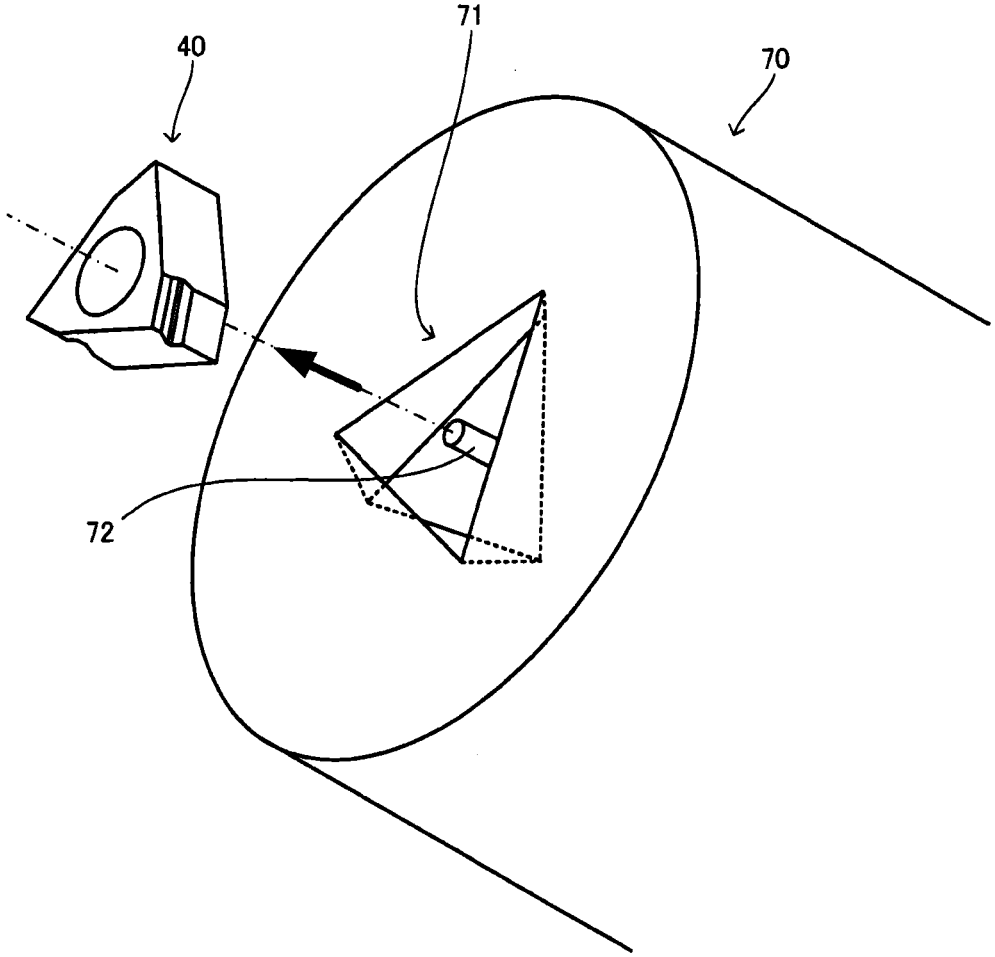
FIG. 10 is a perspective view illustrating a case when the bearing member 40 and the drive shaft 70 engage one another.
Figure 12:
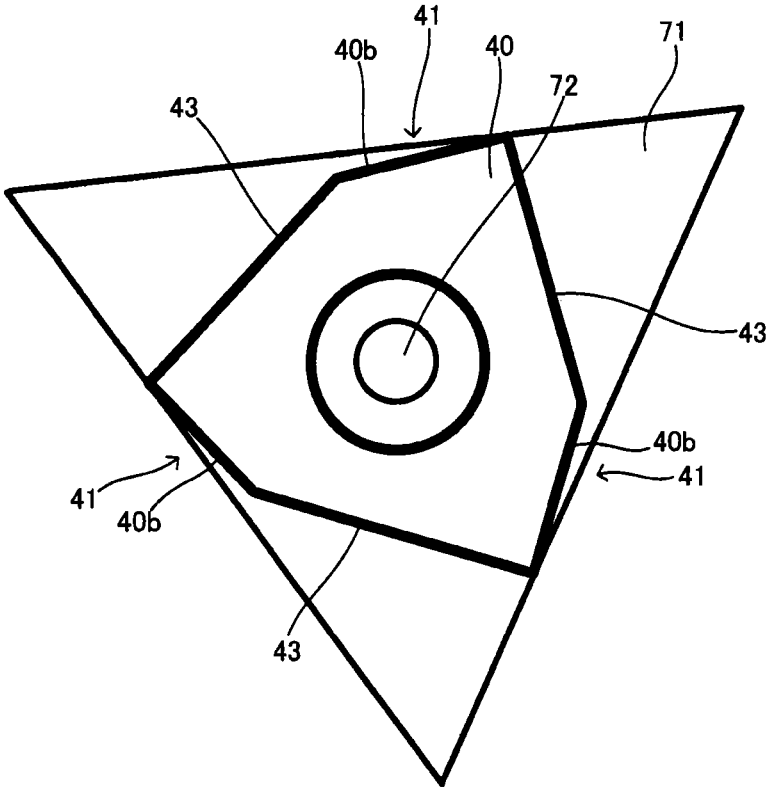
FIG. 12 is a cross-sectional view taken along an arrow line XII-XII in FIG. 11, which illustrates a case in which the bearing member 40 is inserted into a concave portion 71.

FIG. 10 is a perspective view illustrating a scene in which the process cartridge 3 including the photoreceptor drum unit 10 is attached to the apparatus body 2 and the drive shaft 70 is engaged with the bearing member 40. FIG. 11 shows a cross section (end surface diagram) of a posture in which the bearing member 40 included in the end-side member 30 of the photoreceptor drum unit 10 is inserted into the concave portion 71 of the drive shaft 70, along the axial direction. FIG. 12 is a cross-sectional view taken along the arrow XII-XII in FIG. 11. FIG. 12 is a diagram of a state of engagement between the bearing member 40 and the concave portion 71 of the drive shaft 70 at the opening of the concave portion 71 in a posture in which the bearing member 40 is inserted into the concave portion 71 of the drive shaft 70, when viewed in the axial direction.

As shown in FIG. 10, the drive shaft 70 moves in the axial direction as shown by the straight arrow, approaches the bearing member 40, and is inserted thereinto when the bearing member 40 included in the photoreceptor drum unit 10 is inserted into the concave portion 71 of the drive shaft 70.

Then, the bearing member 40 of the end-side member 30 is brought into a state of being inserted into the concave portion 71 of the drive shaft 70 as can be understood from FIGS. 11 and 12. Then, at least a part of the depressions 42 of the rotation force delivering surfaces 41 among the hexagonal outer circumference of the bearing member 40 is brought into contact with the rim of the opening of the concave portion 71 and is connected so as to be able to deliver the rotation force. Moreover, the rotation force from the drive shaft 70 is delivered to the end-side member 30 and rotates the photoreceptor drum 11.

Figure 13:
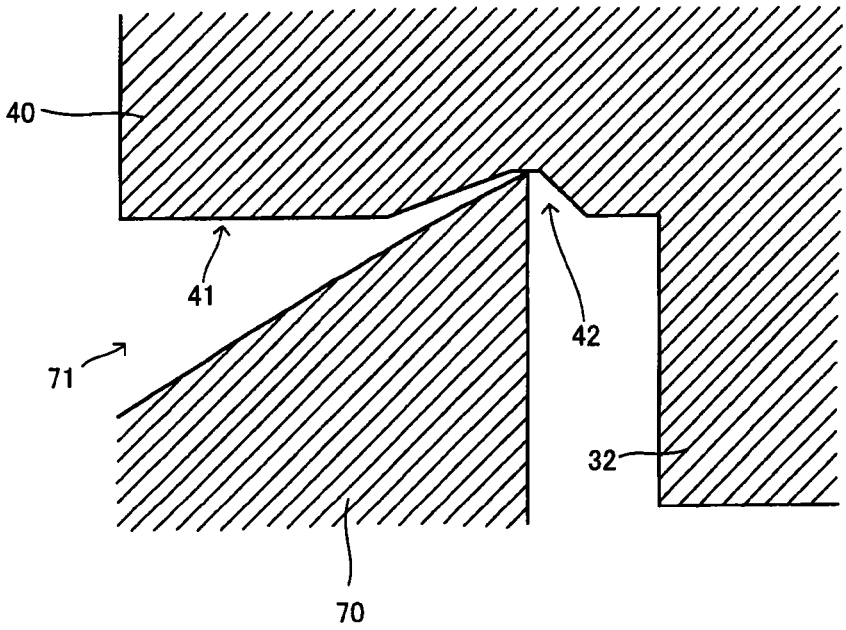
FIG. 13 is a diagram illustrating engagement between the depression 42 and the concave portion 71.

More specifically, the engagement between the bearing member 40 and the drive shaft 70 is performed as follows. That is, since the concave portion 71 of the drive shaft 70 has the twisted configuration in which the cross-sectional shape is rotated along the depth direction as described above, a part at which the rim (edge) formed at the opening of the concave portion 71 forms an acute angle occurs as shown by XIII in FIG. 11. FIG. 13 shows a diagram showing the part XIII in FIG. 11 in an enlarged manner. As shown in FIGS. 11 to 13, the tip end of the rim with the acute angle, which is formed at the opening of the concave portion 71, enters each depression 42 of the bearing member 40, at least a part of the depression 42 is latched by the rim of the concave portion 71, and the engagement between the bearing member 40 and the drive shaft 70 is then stabilized. With such a configuration, stable rotation of the photoreceptor drum 11 is obtained. FIGS. 14A to 14C and FIGS. 15A to 15C show other cases. FIGS. 14A to 14C and FIGS. 15A to 15C are diagrams from the same observing point as that in FIG. 13.

In addition, although the rim (edge) formed at the opening of the concave portion 71 forms the acute angle as described above, the tip end thereof may be formed into an arc shape (a so-called rounded state), or may be chamfered.

Figure 14A:
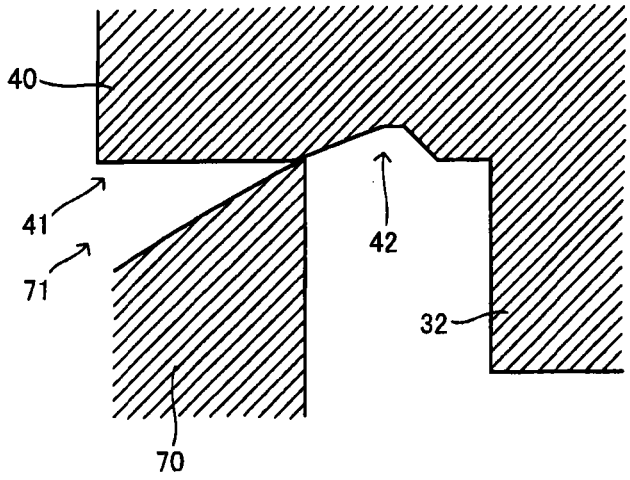
FIG. 14A is a diagram illustrating an exemplary scene in which the depression 42 and the concave portion 71 engage one another.
Figure 14B:
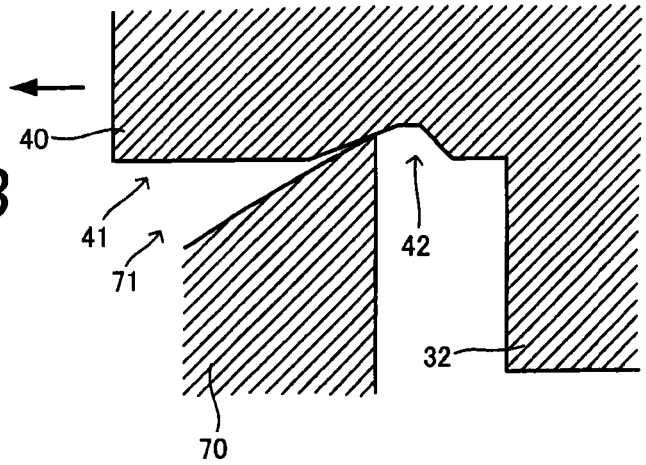
FIGS. 14B and 14C are other diagrams illustrating exemplary scenes in which the depression 42 and the concave portion 71 engage one another.
Figure 14C:
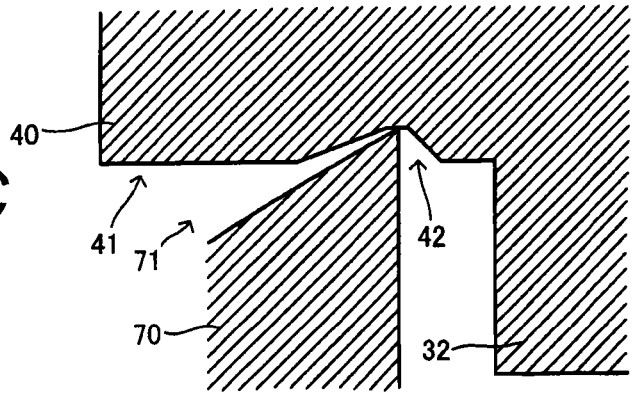

In the example shown in FIGS. 14A to 14C, the following actions are obtained. First, a scene in which the bearing member 40 is slightly inserted into the concave portion 71 before the drive shaft 70 rotates as shown in FIG. 14A will be considered. If the drive shaft 70 starts to rotate from this scene, the rim of the concave portion 71 slides on the tip-end-side inclined surface 40*c* as shown in FIG. 14B due to an action of the tip-end-side inclined surface 40*c* (see FIG. 8A), and the process cartridge 10 moves in the axial direction as shown by the straight arrow in FIG. 14B. Then, the rim of the concave portion 71 is eventually stabilized at a position on the bottom surface 40*b* (see FIG. 8A) as shown in FIG. 14C.

Figure 15A:
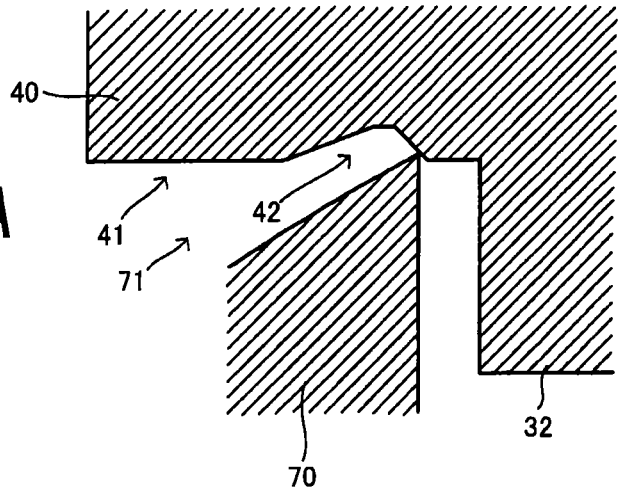
FIG. 15A is a diagram illustrating another exemplary scene in which the depression 42 and the concave portion 71 engage one another.
Figure 15B:
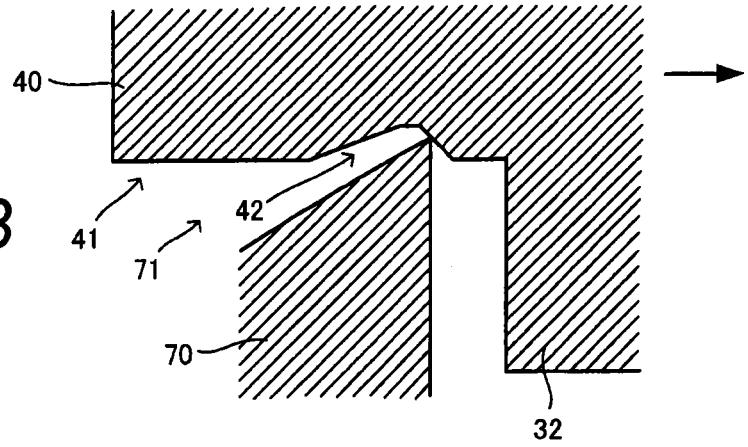
FIGS. 15B and 15C are other diagrams illustrating other exemplary scenes in which the depression 42 and the concave portion 71 engage one another.
Figure 15C:
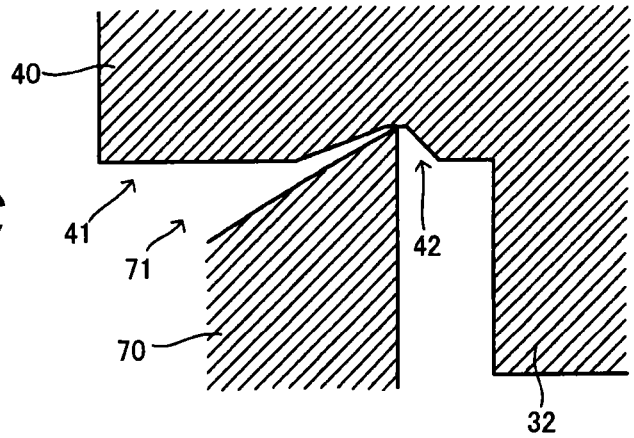

In contrast, the following actions are obtained in the example shown in FIGS. 15A to 15C. First, a scene in which the bearing member 40 is deeply inserted into the concave portion 71 before the drive shaft 70 rotates as shown in FIG. 15A will be considered. If the drive shaft 70 starts to rotate from this scene, the rim of the concave portion 71 slides on the root-side inclined surface 40*a* as shown in FIG. 15B due to an action of the root-side inclined surface 40*a* (see FIG. 8A), and the process cartridge 10 moves in the axial direction as shown by the straight arrow in FIG. 15B. Then, the rim of the concave portion 71 is eventually stabilized at a position on the bottom surface 40*b* (see FIG. 8A) as shown in FIG. 15C.

Since the bearing member 40 is engaged with the concave portion 71 at an appropriate position, and the adjustment thereof is automatically performed, it is possible to easily achieve stable engagement. Therefore, the rotation of the photoreceptor drum 11 is stabilized.

Returning to FIG. 11, the description of the engagement between the drive shaft 70 and the end-side member 30 (process cartridge 10) will be continued. The tip end of the body-side earth member 72 arranged on the side of the drive shaft 70 is inserted into the hole 31*a* of the end-side member 30 and is brought into contact with the tip end of the conductive bar 63. By such an operation, the photoreceptor drum 11, the earth plate 64, the coil spring 62, the conductive bar 63, and the body-side earth member 72 are electrically connected, and electrical continuity is obtained at the parts from the photoreceptor drum 11 to the apparatus body 2.

Here, the coil spring 62 is arranged between the conductive bar 63 and the earth plate 64, and the conductive bar 63 is constantly pressed against the body-side earth member 72, the conductive bar 63 is made to follow a sudden variation in the body-side earth member 72 in the axial direction by the coil member 62*c*, and discontinuity is prevented. In addition, the pressing force in the axial direction from the body-side earth member 72 is absorbed by the coil spring 62 to prevent the earth plate 64 from being strongly pressed. With such a configuration, it is possible to prevent a trouble that the earth plate 64 falls off from the body 31.

Figure 16A:
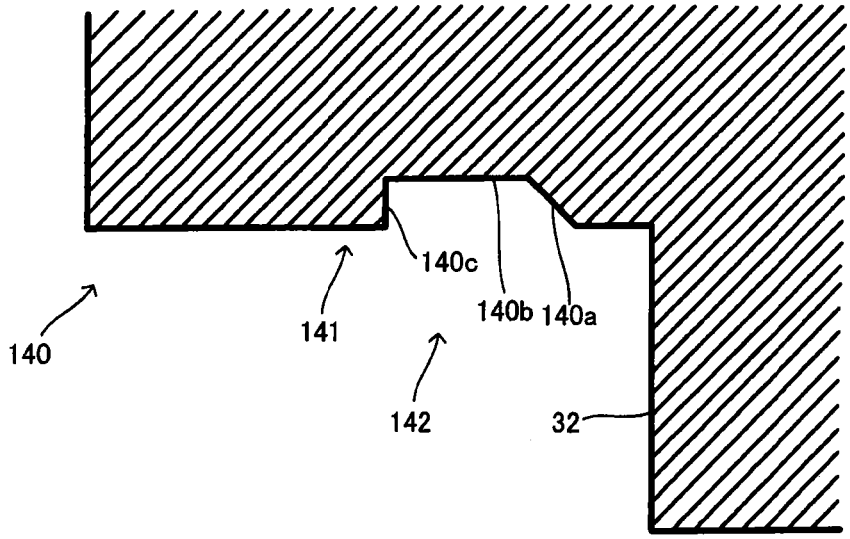
FIG. 16A is a diagram showing a cross-sectional shape of a depression 142.
Figure 16B:
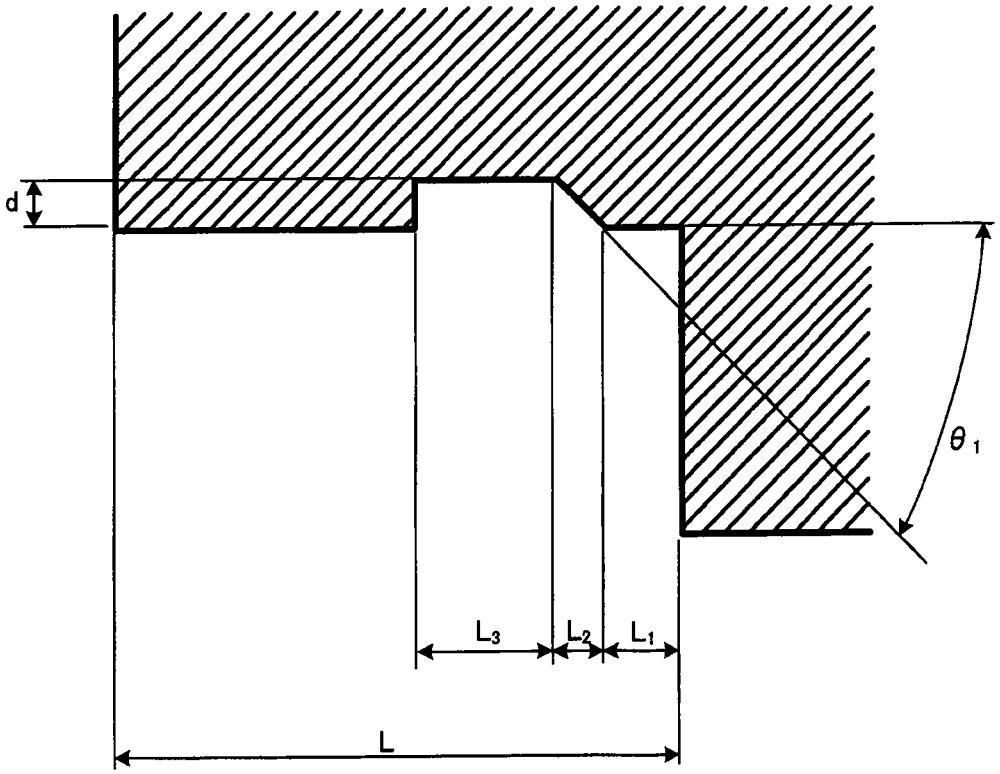
FIG. 16B is a diagram illustrating the dimension of the depression 142.

FIGS. 16A and 16B are diagrams illustrating a second embodiment, which is a diagram when viewed from the same observing point as that in FIGS. 8A and 8B. The second embodiment is an example in which depressions 142 instead of the depressions 42 are applied to rotation force delivering surfaces 141 of a bearing member 140, and only the cross-sectional shape of each depression 142 will be given herein since the other parts are the same as those in the aforementioned embodiment.

As can be understood from FIG. 16A, each depression 142 is provided with a root-side inclined surface 140*a* as a first inclined surface, a bottom surface 140*b*, and a tip-end-side inclined surface 140*c* as a second inclined surface, and $\theta_2$ in Equation (5) is 90° in this example. Accordingly, $L_4$=0 (mm), and the tip-end-side inclined surface 140*c* is formed so as to be vertical with respect to a height direction (a direction along an axial line) of the bearing member 140.

Such a configuration also provides the same effect as that of the aforementioned bearing member 40. Here, it is preferable to satisfy at least one of the aforementioned Equations (1) to (4).

Figure 17A:
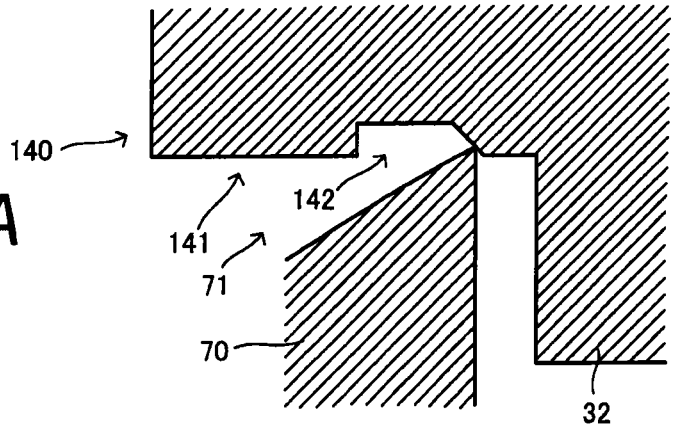
FIG. 17A is a diagram illustrating an exemplary scene in which the depression 142 and the concave portion 71 engage one another.
Figure 17B:
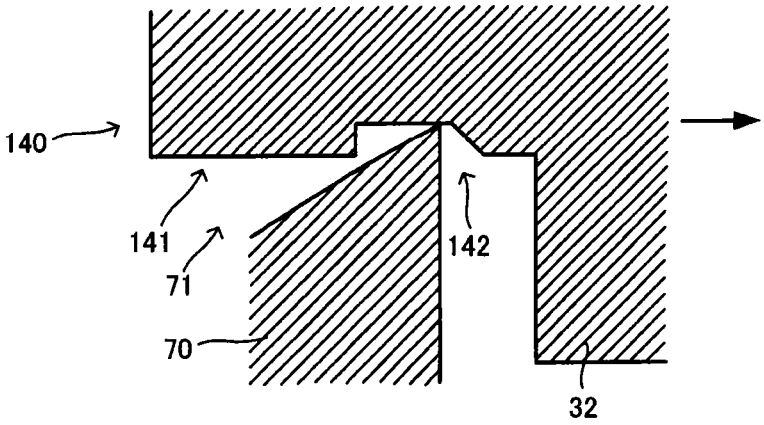
FIGS. 17B and 17C are other diagrams illustrating exemplary scenes in which the depression 142 and the concave portion 71 engage one another.
Figure 17C:
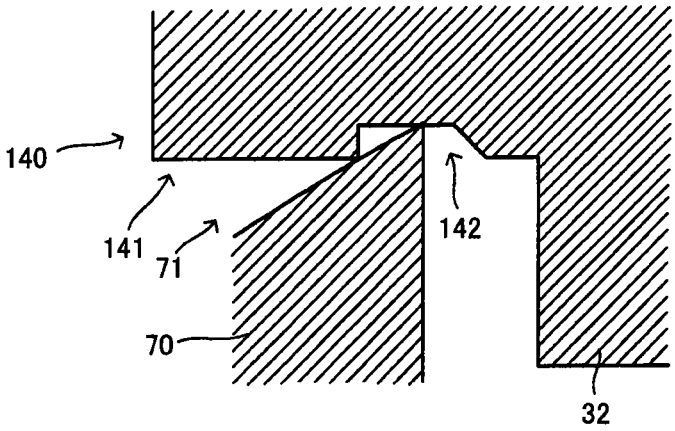

The bearing member 140 provided with the depressions 142 acts as follows, for example, when the bearing member 140 is engaged with the concave portion 71 of the drive shaft 70. FIGS. 17A to 17C are diagrams for illustration. FIGS. 17A to 17C are diagrams when viewed from the same observing point as those in FIGS. 14A to 14C and FIGS. 15A to 15C.

In the example shown in FIGS. 17A to 17C, the following behaviors are observed. First, a scene in which the bearing member 140 is deeply inserted into the concave portion 71 before the drive shaft 70 rotates as shown in FIG. 17A will be considered. If the drive shaft 70 starts to rotate from this scene, the rim of the concave portion 71 slides on the root-side inclined surface 140*a* as shown in FIG. 17B due to an action of the root-side inclined surface 140*a*, and the process cartridge 10 moves in the axial direction as shown by the straight arrow in FIG. 17B and reaches the bottom surface 140*b*. Then, the rim of the opening of the concave portion 71 is eventually present on the bottom surface 140*b* as shown in FIG. 17C, and the rim of the tip-end-side inclined surface 140*c* is brought into contact with the side wall of the concave portion 71.

By the posture shown in FIG. 17C, the engagement between the bearing member 140 and the concave portion 71 is further stabilized.

Figure 18:
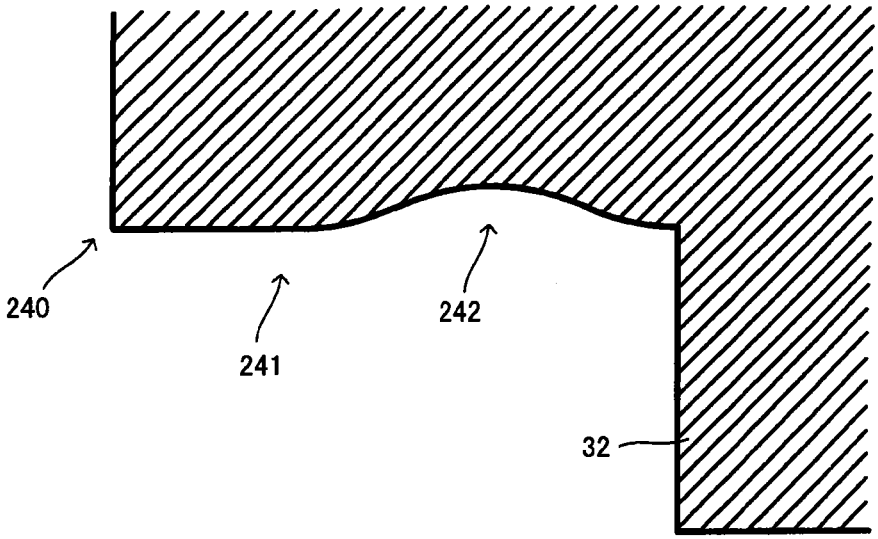
FIG. 18 is a diagram showing a cross-sectional shape of a depression 242.

FIG. 18 is a diagram illustrating a third embodiment, which is a diagram when viewed from the same observing point as that in FIG. 8A. The third embodiment is an example in which depressions 242 instead of the depressions 42 are applied to rotation force delivering surface 241 of a bearing member 240, and only the cross-sectional shape of each depression 242 will be described herein since the other parts are the same as those in the aforementioned embodiments.

Each depression 242 has a bottom portion configured of a curved surface in this example. Accordingly, although the depression 242 does not have obvious boundaries such as the root-side inclined surfaces 42*a* and 142*a*, the bottom surfaces 42*b* and 142*b*, and the tip-end-side inclined surfaces 42*c* and 142*c* of the aforementioned depressions 42 and 142, the depression 242 has a surface which has the same functions as those in the above description as a whole, and the same effect as that in the above description is achieved.

Figure 19:
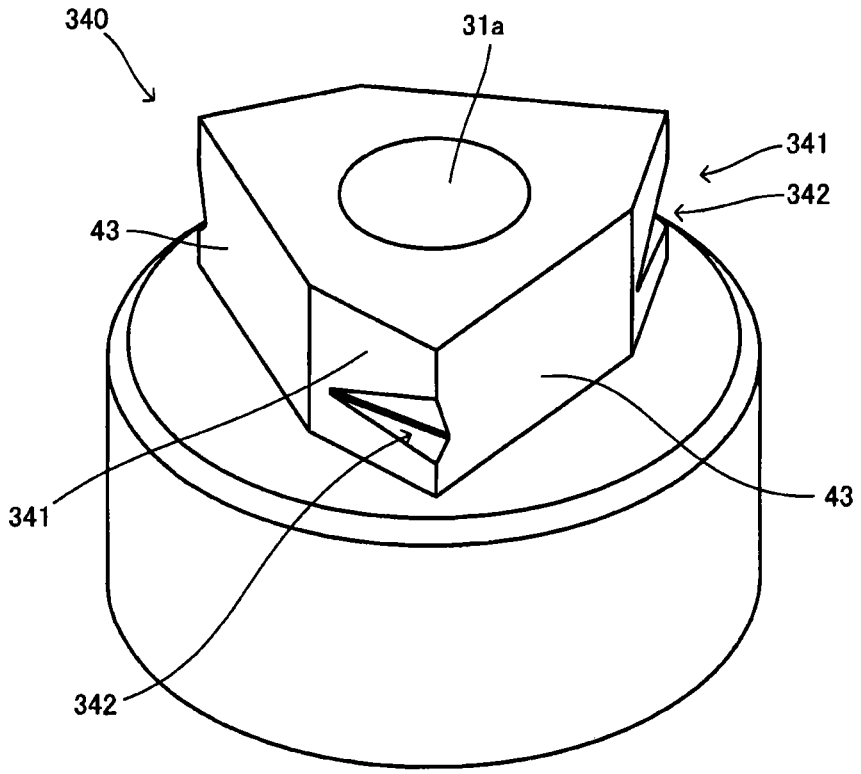
FIG. 19 is a perspective view mainly showing a bearing member 340.

FIG. 19 is a diagram illustrating a fourth embodiment, which is a diagram when viewed from the same observing point as that in FIG. 6. The fourth embodiment is an example in which depressions 342 instead of the depressions 42 are applied to rotation force delivering surfaces 341 of a bearing member 340, and only the depressions 342 will be described herein since the other parts are the same as those in the aforementioned embodiments.

The depressions 42, 142, and 242 described hither to maintain the cross-sectional shapes in the longitudinal directions thereof as shown in FIG. 6 and extend so as to cross over the adjacent connecting surfaces 43. That is, the depressions 42, 142, and 242 have, at any parts in the longitudinal direction, the same cross-sectional shapes in a direction orthogonal to the longitudinal direction, namely a direction along an outer circumferential direction of the bearing member, and referring to FIG. 7, for example, the cross-section of the depression 42 has the same shape if the line shown as VIII-VIII is set at any parts in the rotation force delivering surface 41. In contrast, an area of the cross section of the bearing member 340 in a direction orthogonal to a direction extending in an outer circumferential direction of the bearing member 340 (longitudinal direction) is gradually reduced, and the depression 342 gradually becomes shallower, is the deepest on a side of one connecting surface 43, and disappears before reaching the other connecting surface 43. That is, an inclination of the bottom portion of the depression 342 in the longitudinal direction is not in parallel with the rotation force delivering surface 341, and the depression 342 has a predetermined inclination.

Figure 20:
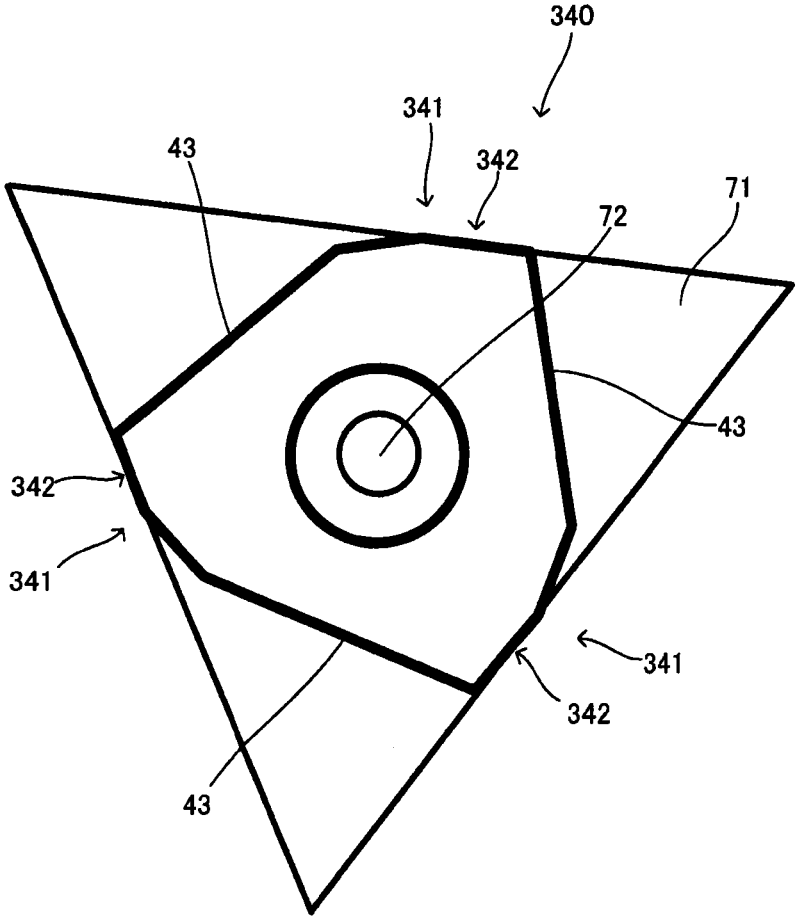
FIG. 20 is a diagram illustrating a scene in which the bearing member 340 is inserted into the concave portion 71 of the drive shaft 70 when viewed from the same observing point as that in FIG. 12.

By such depressions 342, the following actions are achieved in addition to the aforementioned effect. FIG. 20 is a diagram for illustration.

FIG. 20 is a diagram corresponding to FIG. 12, which is a diagram of a state of engagement between the bearing member 340 and the concave portion 71 of the drive shaft 70 at the opening of the concave portion 71 in a posture in which the bearing member 340 is inserted into the concave portion 71 of the drive shaft 70, when viewed from the axial direction. As for the bearing member 340, the bottom portion of the depression 342 is not in parallel with the rotation force delivering surface 341 in the longitudinal direction of the depression 342 as described above, and is thereby configured so as to be brought into contact with the rim (edge) at the opening of the concave portion 71 in a wide range as shown in FIG. 20. That is, the depression 342 is formed such that at least all the three sides formed by a deepest part of the depression 342 coincide and are overlapped with the rim of the concave portion 71 at a cross section including the deepest part of the depression 342 among the cross sections in a direction orthogonal to the axial direction of the bearing member 340.

As can be understood from FIG. 12, only a part of the bottom surface 40*b* of the depression 41 is in contact with the rim of the concave portion 71 in the case of the bearing member 40. In contrast, the depression 342 is in contact with the concave portion 71 over a wide range in the case of the bearing member 340. Therefore, according to the bearing member 340, it is possible to provide a large contact portion when the rotation force is delivered and to alleviate concentration of burden.

Next, a description will be given of manipulations and operations of the image forming apparatus 1 as described above.

For attaching the process cartridge 3 to the apparatus body 2, the process cartridge 3 is inserted into the apparatus body 2 along a predetermined guide as shown in FIG. 1. In this process, the drive shaft 70 of the apparatus body 2 is in a posture of retreating from a moving track of the process cartridge 3.

After the process cartridge 3 is accommodated at a predetermined position in the apparatus body 2, the drive shaft 70 moves toward the process cartridge 3 as shown in FIG. 10 in conjunction with or independently from an operation of closing the cover of the apparatus body 2, the bearing member 40 is inserted into the concave portion 71 of the drive shaft 70 as shown in FIGS. 11 and 12, and both the components are engaged coaxially. By such operations, rotation drive force from the apparatus body 2 is delivered to the bearing member 40, 140, 240, or 340, the end-side member 30, and the photoreceptor drum 11, and the bearing member 40, 140, 240, or 340, the end-side member 30, and the photoreceptor drum 11 can rotate about the axial line in synchronization with each other. In addition, the rotation drive force from the apparatus body 2 is also delivered to other components (such as charging roller 4) provided in the process cartridge 3 in a direct manner or via another member, and the components can also rotate.

As described above, the image forming apparatus is activated in a posture in which the process cartridge 3 is attached and the photoreceptor drum 11 and the like can rotate. When desired characters and drawings are printed on a recording medium, the rotation drive force is applied from the apparatus body 2, the photoreceptor drum unit 10 rotates, and the photoreceptor drum 11 is charged by the charging roller 4.

The photoreceptor drum 11 is irradiated with laser light corresponding to image information by using various optical members, which are not shown in the drawing, in a state where the photoreceptor drum unit 10 rotates, and an electrostatic latent image based on the image information is obtained. The latent image is developed by the developing roller 5.

In contrast, the recording medium such as a paper is set at another part of the apparatus body 2, transported to a transfer position by a feeding roller, a transport roller, and the like provided in the apparatus body 2, and moves along the line II in FIG. 2. Transfer means 1*a* is arranged at the transfer position, voltage is applied to the transfer means 1*a* when the recording medium passes therethrough, and the image is transferred from the photoreceptor drum 11 to the recording medium. Thereafter, the image is fixed to the recording medium by applying heat or pressure to the recording medium. Then, the recording medium with the image formed thereon is discharged from the apparatus body 2 by a discharge roller or the like.

In the photoreceptor drum 11, the cleaning blade 7 is brought into contact with the outer circumferential surface of the photoreceptor drum 11, and the tip end thereof removes a developer remaining after the transfer for the next image. The developer removed by the cleaning blade 7 is discharged by a known method.

What is claimed is:

1. An end-side member to be arranged at an end of a photoreceptor drum unit which is detachably attached to an image forming apparatus body, the image forming apparatus body including a drive shaft having a concave portion, wherein the concave portion is a hole having a triangular cross-sectional shape and twisted in an extending direction of an axial line of the drive shaft and a projection member projecting from the concave portion along the axis of the drive shaft, the end-side member comprising:

a convex-shaped bearing member which is engageable with and disengageable from the concave portion, wherein a depression to be engaged with a rim of an opening of the concave portion is formed in at least a part of an outer circumferential surface of the bearing member, wherein a hole extends along an axis of the end-side member, and wherein the projection member that projects from the concave portion is configured to be inserted into the hole.

2. The end-side member according to claim 1, wherein a cross section of the bearing member in a direction orthogonal to an axial line of the bearing member has a polygonal shape, wherein the polygonal shape is a hexagonal shape, wherein the depression includes a first inclined surface, a bottom surface, and a second inclined surface in this order in a direction along the axial line of the bearing member from a root side toward a tip end side of the bearing member, and wherein at least one of the following equations (1) to (5) is satisfied:

$$0.1 \le L_1/L \le 0.85 \quad (1);$$

$$0 \le L_3/L \le 0.65 \quad (2);$$

$$0.01 \le d/L \le 0.4 \quad (3);$$

$$1° \le \theta_1 \le 90° \quad (4); \text{ and}$$

$$1° \le \theta_2 \le 90° \quad (5),$$

where L (mm) represents a length in an axial direction of the bearing member, $L_1$ (mm) represents a distance from a root of the bearing member to an end of the depression at the root-side of the bearing member, $L_3$ (mm) represents a distance of the bottom surface along the axial direction of the bearing member, d (mm) represents a depth of the depression, $\theta_1$ (°) represents an inclination angle of the first inclined surface with respect to the direction along the axial direction of the bearing member, and $\theta_2$ (°) represents an inclination angle of the second inclined surface with respect to the direction along the axial line of the bearing member.

3. The end-side member according to claim 1, wherein a depth of the depression becomes shallower in a direction along an outer circumferential direction of the bearing member.

4. The end-side member according to claim 1, wherein a cross section including the deepest part of the depression among cross sections in a direction orthogonal to the axial line of the bearing member has a shape by which at least all three sides of the cross section including the deepest part of the depression are overlapped with a part of a rim formed at an opening of the concave portion so as to coincide with the part of the rim.

5. A photoreceptor drum unit comprising:

a photoreceptor drum; and the end-side member as defined in claim 1, which is arranged on at least one end of the photoreceptor drum.

6. A process cartridge comprising:

the photoreceptor drum unit as defined in claim 5;

a charging roller which charges the photoreceptor drum in the photoreceptor drum unit;

a developing roller which develops an electrostatic latent image on the photoreceptor drum; and a case body which accommodates the photoreceptor drum, the charging roller, and the developing roller.

7. The end-side member according to claim 1, wherein the triangular cross-sectional shape of the concave portion has arc shaped tips.

* * * * *